United States Patent [19]

McGowen

[11] 3,930,286

[45] Jan. 6, 1976

[54] FLEXIBLE CONTAINER HAVING VALVE WITH PUNCTURING PLUNGER

[75] Inventor: Inez Madeleine McGowen, San Rafael, Calif.

[73] Assignee: United Vintners, Inc., San Francisco, Calif.

[22] Filed: Dec. 9, 1974

[21] Appl. No.: 530,877

[52] U.S. Cl. ..... 222/83; 222/105; 222/522; 229/14 B; 229/55

[51] Int. Cl.[2] ..... B67B 7/26; B67B 7/28

[58] Field of Search ..... 222/81, 83, 89, 92, 105, 222/107, 180, 181, 183, 215, 519, 522; 229/14 B, 55; 141/19, 114, 313, 329, 330; 128/214 D, 274, DIG. 24

[56] References Cited

UNITED STATES PATENTS

| | | | |
|---|---|---|---|
| 2,379,327 | 6/1945 | Waite | 222/522 |
| 2,574,989 | 11/1951 | Waite | 222/522 |
| 3,206,075 | 9/1965 | Scholle | 222/105 |
| 3,239,104 | 3/1966 | Scholle | 222/89 X |
| 3,339,721 | 9/1967 | Goldstein | 229/14 B |
| 3,349,965 | 10/1967 | Krugger | 222/105 |
| 3,521,807 | 7/1970 | Weisberg | 229/14 B |
| 3,696,969 | 10/1972 | DeVaun et al. | 222/105 |

*Primary Examiner*—Robert B. Reeves
*Assistant Examiner*—David A. Scherbel

[57] ABSTRACT

Wine or other beverage receptacle comprising a flexible container of sheet-like material having affixed thereto a valve which is capable of puncturing the sheet to provide an outlet, together with a rigid or semi-rigid support having an opening to receive and support the valve and to support the container and its contents in upright position for display and dispensing.

3 Claims, 13 Drawing Figures

FLEXIBLE CONTAINER HAVING VALVE WITH PUNCTURING PLUNGER

This invention relates to receptacles for wine and other beverages.

Typically wine is packaged in glass bottles. However, there exists a substantial market for wine packaged in flexible sheet-like containers or bags but a difficulty involved is that these bags are not self-sustaining and cannot be set upright on a shelf or table for display or dispensing. There are available today a number of sheet materials such as laminates of polyester - foil - polyester - polypropylene (the polypropylene being intended to contact the wine) which are suitable as wine containers, but because of the lack of means heretofore for properly supporting them for display and dispensing, they have not been used or have been used only to a limited extent.

It is an object of the present invention to provide improvements in the packaging of wine and other beverages.

It is another and more particular object of the present invention to provide a flexible container for wine and other beverages which obviates the difficulties mentioned above and is provided with means for supporting the packaged wine for display and for dispensing.

The above and other objects of the invention will be apparent from the ensuing description and the appended claims.

One embodiment of the invention is illustrated by way of example in the accompanying drawings in which.

Figures 1, 2, 3, 4, 5, 6, 7:
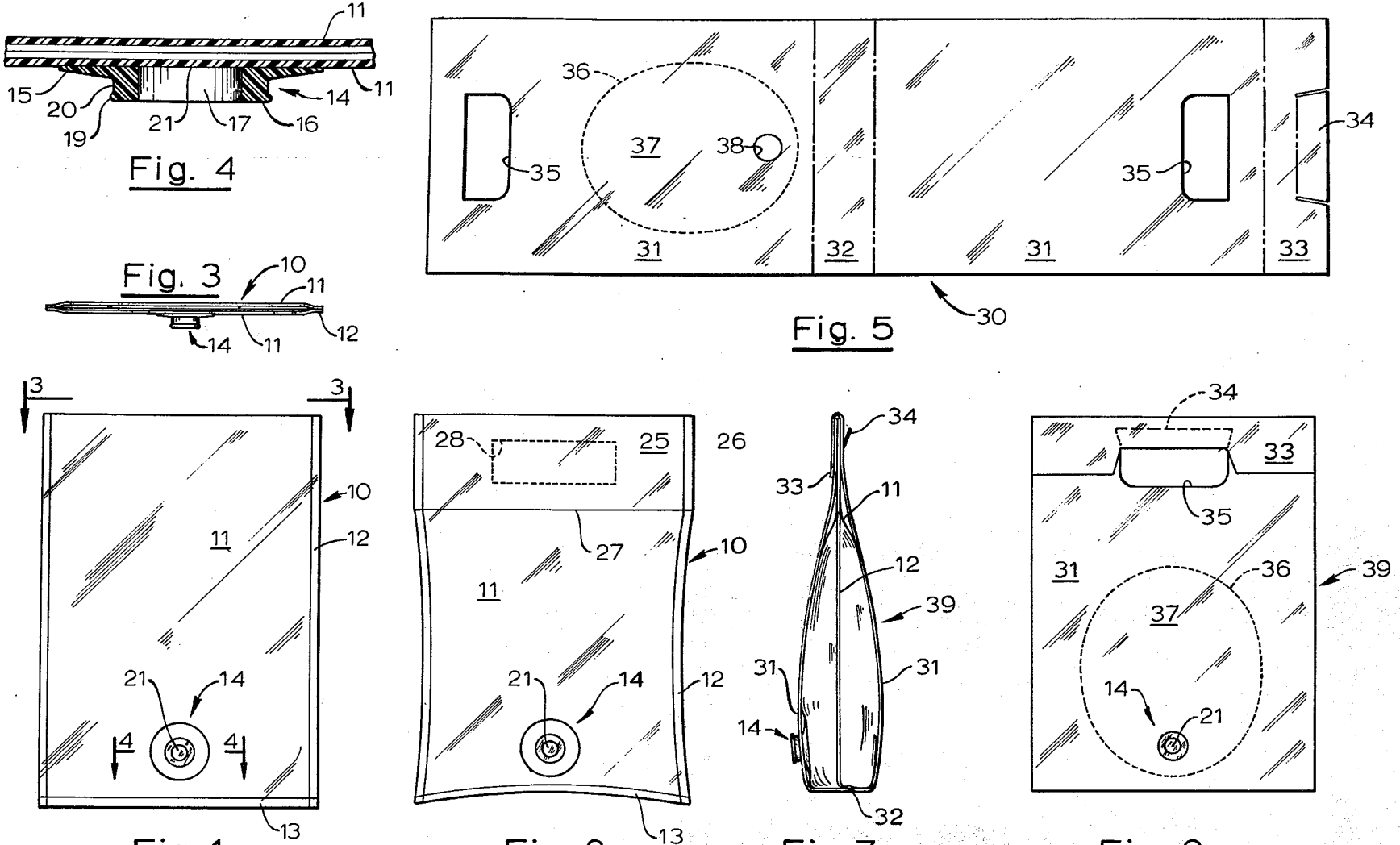
FIG. 1 is a plan view of the flexible bag-like container prior to filling and sealing.
FIG. 2 is a similar view of the same container filled with wine and sealed.
FIG. 3 is an end view taken along the line 3—3 of FIG. 1.
FIG. 4 is a sectional view on a larger scale taken along the line 4—4 of FIG. 1.
FIG. 5 is a plan view of the blank for a semirigid holder and support for the filled container.
FIG. 6 is a view of the complete package including the filled bag and holder showing their appearance when on display, in storage or in dispensing position.
FIG. 7 is a view as seen from the right of FIG. 6.

Referring now to the drawings and preliminarily to FIGS. 1, 2, 3 and 4, a flexible sheet-like container is there shown and generally is designated as 10. It comprises two identical halves 11 which may be of any suitable flexible sheet-like plastic material such as a laminate of polyester - aluminum foil - polyester-polypropylene or polyester- aluminum foil - copolymer or blend of polyester and polyethylene provided that it is compatible with the beverage which it is to contain, for example, a still wine. In the examples given the first named layer would be on the outside and the last named layer would be on the inside in contact with the wine. The two sheets are sealed together along their longitudinal edges 12 and their bottom edges 13, for example, by heat sealing.

Referring now to FIG. 4, a sealing ring generally designated by the reference numeral 14 is there shown. It comprises a flange 15, a neck 16 formed with a central axial passage 17 and an annular rib 19 defining an annular groove 20. The flange 15 is affixed to the exterior of the bag by heat sealing or by an adhesive, preferably by heat sealing.

As will be seen, the circular area 21 of the bag which is adjacent the axial passage 17 is unperforated at this stage.

Referring to FIG. 2, the open ended bag or envelope 10 shown in FIG. 1 is filled with wine or other beverage and then it is heat sealed at 25 and along the edges 26 down to a level indicated by the line 27. Further, the heat sealed portion 25 is cut away to provide a finger opening 28 for a purpose described hereinafter.

Referring now to FIG. 5, a die cut blank generally designated as 30 is there shown. This blank is preferably made of paperboard of other inexpensive rigid or semirigid material which can be die cut and folded along the crease lines shown as broken lines. The blank 30 is composed in two halves 31 of the same size and shape, separated by an area 32. One of the body halves 31 has an end portion or flap 33 which is die cut at its outer edge to provide a tab 34 and further it is die cut below the flap 33 to provide a finger opening 35. The other half 31 of the blank has a matching opening 35 and it is also scored or grooved at 36 to define an oval cut-out portion 37 which can be readily removed for a purpose described below. This cut-out portion 37 is formed with a circular opening 38 for a purpose described below.

Referring now to FIGS. 6 and 7, the bag 10 filled with wine or other beverage and sealed as described above and with its sealing ring 14 in place is placed over the base portion 32 of the blank 30, the two halves 31 are folded about the score lines that separate them from base 32 so as to form a tent-like enclosure generally designated as 39, and the flap 33 is folded over and the tab 34 is folded back to provide a hand hold. The neck 16 of the sealing ring 14 is slipped through the circular opening 38.

Figure 8:
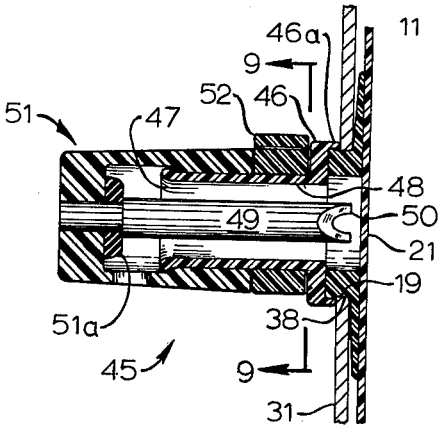
FIG. 8 is a view in vertical midsection of the dispensing valve employed with the wine container of the invention.
Figure 9:
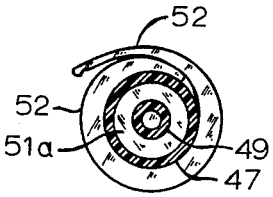
FIG. 9 is a view as seen from the left of FIG. 8.
Figure 10:
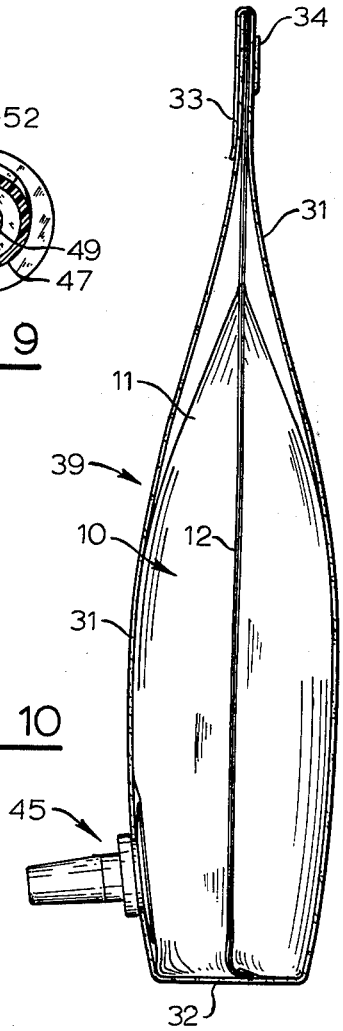
FIG. 10 is a view in side elevation of the wine container in its holder as in FIG. 7 but with the dispensing valve attached.

Referring now to FIG. 8, a valve is provided which is generally designated as 45. This valve has a flange 46 formed with an annular retainer ring **46*a* which is slipped over the rib 19 of the neck 16 of sealing ring 14, by which means the valve is attached to sealing ring and the bag. A tubular member 47 is provided which is integral with the flange 46. The tube 47 has an axial passage 48 for dispensing wine in the manner described below. A plunger 49 is provided having a sharpened knife edge 50 at its inner end and a knob 51 at its outer end. A keeper or lock member 52 is provided which, as shown in FIG. 9, may be of spiral configuration and which is interposed between the inner end of the knob 51 and the flange 46. As will be apparent, the bag containing the wine is intact until such time as the plunger 49 is thrust inwardly. Normally, the plunger is kept from being thrust inwardly by the keeper 52. However, upon stripping away the keeper 52, the plunger is free to be thrust inwardly. This is accomplished when it is desired to dispense the wine simply by pushing in on the knob or handle 51. As long as the knob is in its inner position a projection or boss 51a plugs passage 48** and prevents flow of wine, but on pulling it out, wine is dispensed.

It will be apparent that a flexible container for wine and other beverages is provided which has the advantages of packaging wine in a flexible bag and yet is provided with a simple, inexpensive and very effective support in the form of the tent structure 39 and with a very convenient dispensing valve. The structure can be placed upright on a shelf in a liquor store for display. When a person purchases such a package he can store it on a shelf, for example, in a refrigerator until it is desired to dispense the wine and he can stand it up on a table for dispensing.

Dispensing is made very easy by simply stripping away the keeper 52, pushing the knob 51 inwardly and then pulling it out. When as much wine is dispensed as is desired, the knob 51 is pushed in again so as to plug the tube 47. The keeper 52 is deformed or broken when it is removed and its absence, or its damaged condition serves as a telltale that the bag 10 has been opened.

Figure 11:
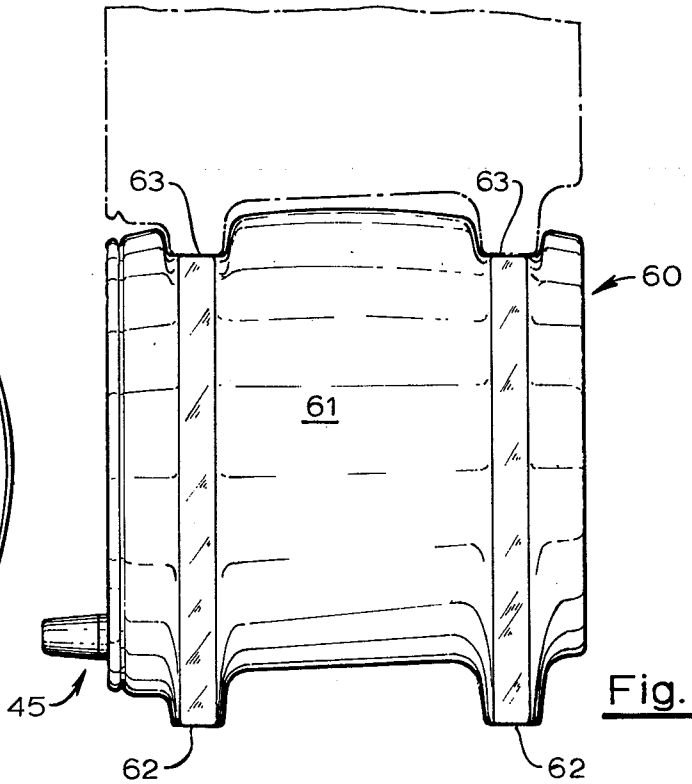
FIG. 11 is a view in side elevation of a barrel shaped dispenser to be used with the filled flexible wine container removed from the support or holder shown in FIG. 10.
Figure 12:
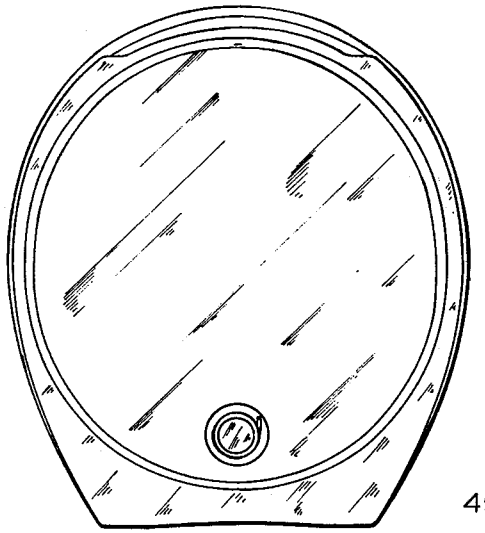
FIG. 12 is a view as seen from the left of FIG. 11.
Figure 13:
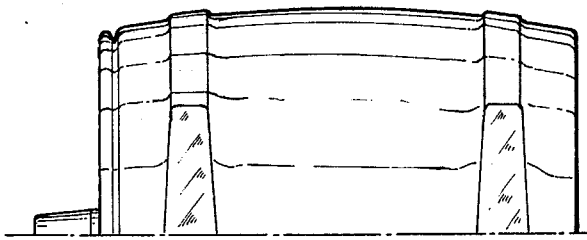
FIG. 13 is a bottom view of FIG. 11.

Yet another advantage of the construction thus shown is illustrated in FIGS. 11, 12 and 13 where there is shown a barrel 60 which may be of any suitable material such as wood, metal or, preferably, a molded plastic. The barrel 60 comprises a body 61 and downwardly projecting legs 62. Diametrically opposite the legs 62 are nesting grooves 63. As will be seen, the legs 62 of one barrel will nest in the grooves 63 of the barrel below so that several barrels may be stacked one upon another. As is shown in FIG. 12, the front end of the barrel (i.e. the left as viewed in FIG. 11) is open at 65 and the shape and size of the opening 65 are such that the cut out portion 37 of the support structure 39 will fit therein as by a snap fit. In use a purchaser will purchase one or more of the wine packages 39 and along with it he will purchase (or will be given as a bonus) one of the barrels 60. He will then tear out the cut out portion 37, will separate the bag and attached cut out 37 from the rest of the support 39, will insert the bag in the barrel 60 through its open end and will fit the cut out portion 37 into the open end 65 of the barrel. This provides an adequate support for the bag of wine and its valve; it is readily accessible and it may be operated to dispense wine as desired. Further, the cut out portion 37 may be suitably decorated, may carry identification of the wine, etc.

When the bag has been emptied, another of the packages will be placed in the barrel. The barrel becomes, therefore, a more or less permanent dispenser to be used over and over again.

It will therefore be apparent that new and useful wine dispensing and container equipment are provided.

I claim:

1. A beverage container-dispenser comprising:

a. a flexible bag having a sealable opening for filling the bag, b. a valve attached to a wall of the bag, said valve having an operating member capable of movement to a closing position in which it closes the valve and which also during such closing movement serves to puncture the bag, said operating member being also movable to a dispensing position wherein it opens the valve to allow dispensing of beverage from the bag, c. a support structure having opposed side walls joined at the top and diverging from top to bottom and having a flat bottom joining the lower edges of the side walls and acting as a base to support the structure and bag in upright display and dispensing position and d. said valve projecting through a wall of the support structure.

2. The container-dispenser of claim 1 wherein the wall of the support structure through which the valve projects has an area surrounding the valve which is weakened so as to be readily removable while remaining attached to the valve.

3. Beverage dispensing construction comprising the structure of claim 2 in combination with a rigid, self-supporting housing having an open end, said area of the support structure, when separated, fitting within such open end.

* * * * *